United States Patent [19]

Artzt

[11] 4,238,033

[45] Dec. 9, 1980

[54] RECEPTACLE FOR MEDICATION

[76] Inventor: William W. Artzt, 333 Sunset Ave., Palm Beach, Fla. 33480

[21] Appl. No.: 800,912

[22] Filed: May 26, 1977

[51] Int. Cl.[3] ..... B65D 85/56

[52] U.S. Cl. ..... 206/534; 215/206; 215/211; 215/224

[58] Field of Search ..... 116/121; 206/533, 534, 206/535, 536, 538, 539, 540, 459; 215/206-211, 224

[56] References Cited

U.S. PATENT DOCUMENTS

| | | | |
|---|---|---|---|
| 2,767,680 | 10/1956 | Lermer | 116/121 |
| 3,383,885 | 5/1968 | Epstein | 215/206 |
| 3,627,160 | 12/1971 | Horvath | 215/224 |
| 3,678,884 | 7/1972 | Robbins | 206/539 |
| 3,860,133 | 1/1975 | Boxer et al. | 215/206 |
| 3,896,958 | 7/1975 | Robbins et al. | 215/211 |
| 3,913,769 | 10/1975 | Scrocco | 215/206 |
| 3,984,031 | 10/1976 | Thompson | 206/538 |
| 4,043,474 | 8/1977 | McCord | 215/211 |

*Primary Examiner*—Herbert F. Ross
*Attorney, Agent, or Firm*—Alvin Sinderbrand

[57] ABSTRACT

A receptacle for pills or other medication to be taken at prescribed intervals of time, for example, every three hours, includes a container with a rim at the top extending around an opening, a lid engageable with the rim for closing such opening and being turnable in respect to the container so that an index on the lid will cooperate with an adjacent scale of hour designations on an exterior surface of the container for selectively indicating various times, and a locking arrangement permitting removal of the lid from the container only when the lid is turned to a selected one of a plurality of angularly spaced apart positions at which the index and scale indicate respective times having the prescribed intervals therebetween.

6 Claims, 8 Drawing Figures

RECEPTACLE FOR MEDICATION

BACKGROUND OF THE INVENTION

1. Field of the Invention

This invention relates generally to receptacles for pills, tablets or other medication, and more particularly is directed to improvements in medication receptacles of the type having a time indicator associated therewith.

2. Description of the Prior Art

When prescribing a drug in the form of pills or tablets, it is customary for the doctor to indicate that a specified number of the pills or tablets are to be taken or administered at certain time intervals, for example, at three hour intervals. Further, two or more drugs may be prescribed for a patient and may be required to be taken or administered at different time intervals, for example, pills or tablets containing one drug may have to be taken every three hours while pills or tablets containing another drug may have to be taken every four hours. Frequently, the patient or nurse encounters difficulty in remembering when the last dose of a particular medication was taken or administered, and such difficulty is particularly encountered in the described situation where two or more drugs are to be taken at different time intervals. In such circumstances, there is always the danger that one of the drugs may be taken too frequently, or that the time intervals prescribed for the respective drugs may be interchanged.

In an attempt to assist patients and/or nurses in accurately recalling when a medication, for example, in the form of pills or tablets, was last taken or administered, it has been proposed to provide medication receptacles with time indicators. Many of the existing medication receptacles with time indicators, for example, as disclosed in U.S. Pat. Nos. 1,425,456, 2,066,183, 2,111,637 and 3,960,713, include a container for the pills, tablets or other medication having an opening at the top and a closure or cap for sealing such opening which is comprised of two relatively rotatable parts. One of the relatively rotatable closure parts has a circularly arranged scale of spaced apart hour designations and the other of such parts has an index cooperating with the scale for selectively indicating various time in response to relative turning of the two parts of the closure. In another proposed medication receptacle with a time indicator, for example, as disclosed in U.S. Pat. No. 3,766,882, the container for holding the pills, tablets or other medication is provided with a bead extending around the opening at the top of the container, and a closure or lid is adapted to snap over such bead for closing the container and, in such closed condition, is adapted to turn relative to the container so that an index or pointer on the lid may cooperate with a scale of hour designations spaced apart about the container immediately below the lid for selectively indicating various times in response to turning of the closure or lid relative to the container.

In using the above described existing medication receptacles, the time indicator is positioned to indicate the time when a pill, tablet or other medication from the respective receptacle or container has been administered or taken so that, thereafter, the prescribed time interval to the next taking or administering of the medication can be readily calculated. However, the foregoing assumes that the patient or nurse will correctly remember the time interval prescribed for the medication in a particular receptacle and will not confuse such time interval with the time interval for another medication prescribed for the patient. Such assumption may not be justified, particularly when the various medications are being taken by the patient without supervision, and when the condition or illness being treated, or one or more of the medications may induce a lack of alertness.

Widespread use has also been made of so-called child-proof receptacles for pills, tablets or other medication in which, for example, a lid for sealing or closing the opening at the top of a container is turnable relative to the latter and is removable from the container only when the lid is disposed in a single predetermined rotational position in respect to the container. Such predetermined rotational position of the lid is established by alignment of an arrowhead or other index embossed on the lid with the corresponding index provided on an adjacent portion of the container. Since an infant or very young child would not know, or have the manual dexterity necessary to effect alignment of the indices on the lid and container prior to seeking to remove the lid, the described receptacle is generally effective to prevent accidental ingesting of the medication contained therein by an infant or young child. However, the described child-proof medication receptacles do not assist an adult nurse or patient in administering or taking medication or medications at the prescribed time intervals therefor.

OBJECTS AND SUMMARY OF THE INVENTION

Accordingly, it is an object of this invention to provide an improved receptacle for pills, tablets or other medication which facilitates and ensures the taking or administering of such medication at prescribed time intervals.

More particularly, it is an object of this invention to provide a receptacle for medication comprising a container with a lid for closing the same, a time indicator which is actuable for selectively indicating various times, and a locking arrangement permitting removal of the lid from the container only when the time indicator indicates respective times having prescribed intervals therebetween.

Another object is to provide a receptacle for medication, as aforsaid, which is of very simple and inexpensive construction so as to permit and encourage the economical and widespread use thereof.

A further object is to provide a receptacle for medication, as aforesaid, which will ensure that various medications to be taken or administered at different time intervals will be properly taken or administered at the correct respective time intervals.

In accordance with an aspect of this invention, a receptacle for medication to be taken at prescribed intervals of time comprises a container member having an opening at the top thereof with a generally circular rim extending around such opening, a lid member engageable with the rim for closing the opening and being rotatable in respect to the rim when engaged with the latter, one of the container and lid members having a scale of hour designations angularly spaced apart thereabout adjacent the other of such members which has an index thereon cooperating with the scale for selectively indicating various times in response to relative turning of the lid and container members, and cooperative locking means on the lid member and the rim of the container member for permitting removal of the lid member only when the latter is turned to a selected one of a plurality of angularly spaced apart positions at which the index and scale indicate respective times having the prescribed intervals therebetween.

In a preferred embodiment of the invention, the rim of the container has an inner portion defining a downwardly facing annular shoulder at the inside of the container member so as to constitute a part of the locking means, the lid member includes a top wall having a peripheral portion adapted to seat on the top of the rim when the lid member is in its closed position and a circular flange depending from such top wall and spaced inwardly from the periphery of the latter so as to fit into the container opening and extend below the shoulder of the inner rim portion when the top wall of the lid member seats on top of the rim, the locking means further includes a keeper projecting radially outward from the lower portion of the lid member flange so as to engage under the shoulder of the rim when the top wall seats on the rim, the inner portion of the rim has a plurality of angularly spaced apart recesses opening radially inward and extending from the shoulder to the top of the rim, such recesses being disposed to angularly register with the keeper in the angularly spaced apart positions, respectively, of the lid member relative to the container member, and each of the recesses is dimensioned to permit the passage therethrough of the keeper during movement of the lid member to and from its closed condition when such lid member is in the respective one of its angularly spaced apart positions relative to the container member.

Further, in a preferred embodiment of the invention, the lid member has a tab extending radially outward from the periphery of its top wall and being substantially radially aligned with the keeper so that upward displacement of the tab with the lid member in a selected one of its angularly spaced apart positions relative to the container member is effective to cause the upward travel of the keeper through the respective one of the recesses during removal of the lid member from the container member.

The above, and other objects, features and advantages of the invention, will be apparent in the following detailed description of illustrative embodiments thereof which is to be read in connection with the accompanying drawings.

DESCRIPTION OF PREFERRED EMBODIMENTS

Figure 1:
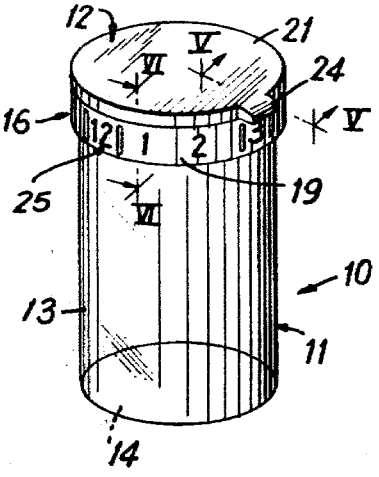
FIG. 1 is a perspective view illustrating a receptacle for medication according to an embodiment of this invention, and which is shown in its closed condition.

Referring to the drawings in detail and initially to FIG. 1 thereof, it will be seen that a receptacle 10 according to this invention for containing pills, tablets or other medication simply comprises a first member in the form of a container 11 which is adapted to be closed by a second member in the form of a lid 12. The container 11 is shown to include a cylindrical side wall 13 and bottom wall 14 (FIGS. 1,2 and 4) preferably integrally molded of a clear or transparent plastic so as to expose to view the pills, tablets or other medication that may be contained in receptacle 10. The container 11 has an opening 15 at the top thereof, and a generally circular rim 16 extends around such opening 15. The rim 16 is also preferably formed of a plastic resin and may be molded integrally with cylindrical side wall 13 or formed separately from the latter and then permanently joined to the upper edge portion of side wall 13, as by heat and pressure or a suitably permanent adhesive.

Figure 6:
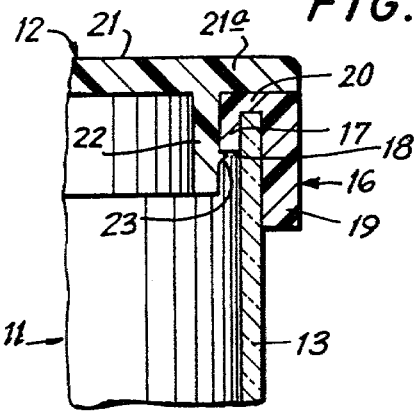
FIG. 6 is an enlarged fragmentary sectional view similar to that of FIG. 5, but taken along the line VI—VI on FIG. 1.

The rim 16 is shown to embrace the upper edge portion of side wall 13 and to include an inner portion 17 defining a downwardly facing annular shoulder 18 at the inside of container 11 (FIG. 6). Rim 16 further includes an outer annular portion 19 extending around the outside of side wall 13 at the upper end of container 11, and a top portion 20 extending across the top edge of side wall 13 between inner and outer portions 17 and 19 for providing a seat for lid 12.

Figure 3:
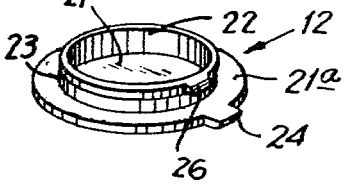
FIG. 3 is a perspective view of the lid member shown inverted for clearly illustrating structural details thereof.
Figure 5:
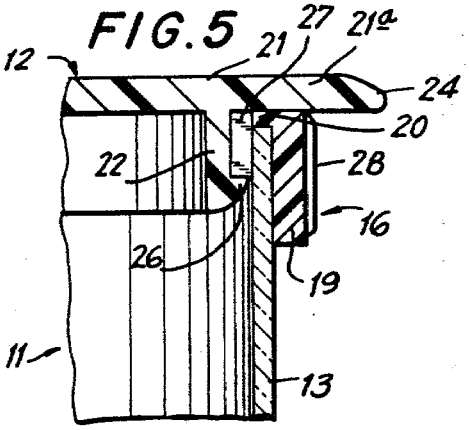
FIG. 5 is an enlarged fragmentary sectional view taken along the line V—V of FIG. 1.
Figure 7:
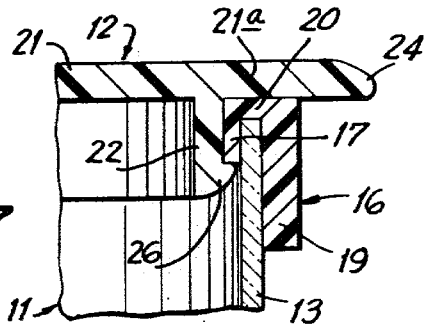
FIG. 7 is an enlarged fragmentary sectional view similar to that of FIG. 5, but showing the lid member turned from the position on FIG. 1 so as to be in its locked condition.

As shown particularly on FIG. 3, lid 12 may include a substantially circular top wall 21 having a peripheral portion 21*a* adapted to seat on top portion 20 of rim 16, and a circular flange 22 depending from top wall 21 and spaced inwardly from the periphery of the latter so as to fit into opening 15 and closely engage inner portion 17 of rim 16. Depending flange 22 is axially dimensioned so as to extend below shoulder 18 at the bottom of inner rim portion 17 when peripheral portion 21*a* of top wall 21 seats on top portion 20 of the rim. The lid 12 is also preferably molded or otherwise formed of a plastic material so as to be elastically deformable to some extent, and the flange 22 is desirably formed with a small annular bead or ridge (FIGS. 3 and 6) extending circumferentially about the outer surface of flange 22 and being spaced from the undersurface of top wall 21 by a distance substantially equal to the distance from the upwardly facing surface of top rim portion 20 to downwardly facing shoulder 18. Thus, when lid 12 is seated on top rim portion 20 for closing opening 15 of container 11, ridge or bead 23 snaps under shoulder 18 (FIG. 6) for yieldably retaining the lid in closing relation to the container. Lid 12 further has a tab 24 extending radially outward from the periphery of top wall 21 so as to project beyond outer rim portion 19 (FIGS. 1,5 and 7) when the lid is in its closed condition. Thus, tab 24 can be conveniently grasped and urged upwardly relative to container 11 for removing lid 12 from the latter with the ridge or bead 23 snapping out from under shoulder 18.

In accordance with the present invention, receptacle 10 is provided with a time indicator which, in the illustrated embodiment, is constituted by a scale 25 of hour designations or indicia "1" to "12", inclusive, printed or embossed on the outer cylindrical surface of outer rim portion 19 at equally angularly spaced apart locations (FIGS. 1 and 2), and cooperating with the tab 24 on lid 12 functioning as an index for selectively indicating various times in response to turning of lid 12 relative to rim 16 on container 11.

Further, in accordance with this invention, receptacle 10 is provided with cooperative locking means on lid 12 and rim 16 of container 11 for permitting removal of lid 12 from the latter only when the lid is turned to a selected one of a plurality of angularly spaced apart positions at which the tab or index 24 and scale 25 indicate respective times having prescribed intervals therebetween. In the illustrated embodiment, such locking means is shown to include a keeper 26 (FIGS. 3 and 7) projecting radially outward from the lower portion of the flange 22 of lid 12 so as to engage under the downwardly facing shoulder 18 of inner rib portion 17 when top wall 21 of the lid seats on top rim portion 20. In order to permit removal of lid 12 when the latter is turned to a selected one of a plurality of angularly spaced apart positions at which the time indicator constituted by tab 24 and scale 25 indicates respective times having prescribed intervals therebetween, inner rim portion 17 of container 11 has a plurality of equally angularly spaced apart recesses 27 (FIGS. 2,4 and 5) opening radially inward and extending from shoulder 18 to the top surface of rim 16. Each of the recesses 27 is dimensioned to permit the vertical passage therethrough of keeper 26 of lid 12 for insertion and removal of the lid when the latter is turned to a respective position in which the keeper 26 is aligned or registered with the respective one of the recesses 27. Further, the keeper 26 is preferably radially aligned with tab 24 on lid 12, and the recesses 27 are preferably radially aligned with respective hour designations of the scale 25, so that the keeper 26 will register with one of the recesses 27 whenever the tab 24 acting as an index registers with the respective one of the hour designations of scale 25.

Figure 2:
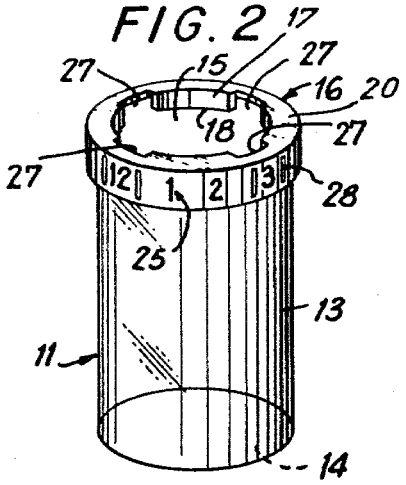
FIG. 2 is a perspective view showing the container member of the receptacle of FIG. 1 with the lid member of the latter removed.
Figure 4:
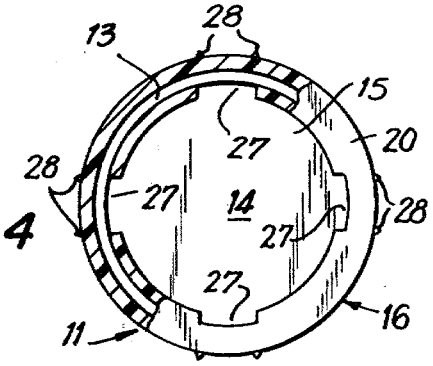
FIG. 4 is an enlarged top plan view of the container member of FIG. 2, with the rim thereof being partly broken away and in section.

The receptacle 10 according to this invention, as illustrated on FIGS. 2 and 4, is intended to contain pills, tablets or other medication prescribed to be taken or administered at three-hour intervals and, therefore, inner rim portion 17 of container 11 is provided with four of the equally angular spaced apart recesses 27 which are respectively radially aligned with hour designations at three-hour intervals, for example, the hour designations "3", "6", "9" and "12" of scale 25. Therefore, when lid 12 is installed on container 11 for closing the latter, the turning of lid 12 to any one of the positions in which tab 24 registers with hour designations "3", "6", "9" and "12" for indicating the respective times will cause keeper 26 to register with a respective one of the recesses 27 (FIG. 5), whereupon tab 24 can be urged upwardly for removing lid 12 from container 11 and, during such removal, keeper 26 will pass through the recess 27 with which it is then registered.

In any of the other rotated positions of lid 12, for example, if the lid is positioned so that its tab 24 functioning as an index is aligned with hour designation 2" of scale 25, keeper 26 engages under downwardly facing shoulder 18 of inner portion 17 (FIG. 7) for positively locking lid 12 in its closed position and preventing the removal of the lid from container 11.

Figure 8:
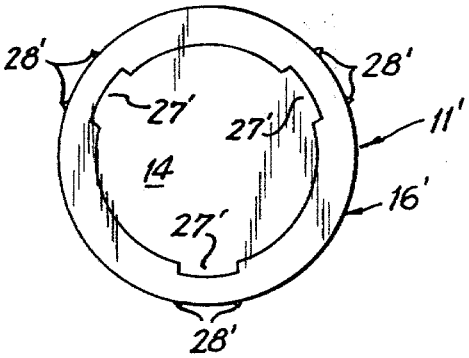
FIG. 8 is a top plan view similar to that of FIG. 4, but illustrating the container member of a receptacle according to this invention for containing medication prescribed to be taken or administered at a different time interval.

As previously mentioned, the rim 16 of container 11 is shown on FIGS. 2 and 4 to be provided with four equally angularly spaced apart recesses 27 so as to adapt such container for pills, tablets or other medication to be taken or administered at three-hour intervals. However, it will be appreciated that, by suitably increasing or decreasing the number of such equally angularly spaced apart recesses provided in the container rim, the container of a receptacle according to this invention may be adapted to contain medication to be taken or administered at different prescribed intervals of time. For example, as shown on FIG. 8, a container 11' of a receptacle according to this invention which may otherwise be the same as the previously described receptacle 10 may have its rim 16' formed with three equally angularly spaced apart recesses 27' so as to be adapted to contain medication prescribed to be taken or administered at four-hour intervals. In such case, the recesses 27' may be aligned with the hour designations "4", "8" and "12" of the scale (not shown) on the outwardly facing cylindrical surface of rim 16'.

The hour designations of scale 25 which correspond to the prescribed time intervals for taking or administering the medication in container 11 or 11' are preferably distinguished from the other hour designations of scale 25, for example, by being printed in a distinctive color, by being distinctively embossed or, as shown, by being bracketed between protrusions 28 (FIGS. 2,4 and 5) or 28' (FIG. 8) extending from the outwardly facing cylindrical surface of rim 16 or 16'.

It will be apparent that, when filling a prescription specifying that the respective medication is to be taken or administered at certain time intervals, the pharmacist will place or package such medication in a receptacle according to this invention having its number of recesses 27 or 27' corresponding to the prescribed time intervals. In other words, if the prescription requires that the medication be taken or administered at three-hour intervals, such medication will be packaged in a receptacle having its container 11 provided with four recesses 27, as shown on FIGS. 2 and 4. On the other hand, a medication prescribed to be taken or administered at four-hour intervals will be packaged in a receptacle having only three recesses 27' as shown on FIG. 8.

In using the medication receptacle according to this invention, each time the lid 12 is removed from container 11 or 11' so as to permit a pill or tablet to be taken therefrom, the lid is thereafter returned to its closed position on the container and rotationally positioned so that its tab or index 24 will cooperate with scale 25 for indicating such time at which the pill was last taken or administered. For example, if a pill or tablet is taken at 12 o'clock, the lid 12, upon its return to the closed position on container 11, is turned to the position in which tab or index 24 registers with the hour designation "12" of scale 25. The next distinctive hour designation of scale 25, for example, the hour designation "3" bracketed by protrusions 28 in the case of a medication being dispensed from container 11, clearly indicates the time when another pill, tablet or other dose of the respective medication is to be administered or taken. Therefore, at 3 o'clock, lid 12 is turned to the position in which its tab or index 24 registers with hour designation "3". Thus, the nurse or patient administering or taking the pills in question is provided with a clear indication that the pills or tablets contained in the respective container 11 are to be administered only at three-hour intervals. If it is inadvertently attempted to take another pill after only a two-hour interval, for example, at 2 o'clock, the turning of lid 12 to the position at which tab 24 registers with hour designation "2" would not register keeper 26 with one of recesses 27 and, therefore, lid 12 would remain locked to abort such inadvertent attempt. If the patient is also to take or be given pills at four hour intervals, for example, from a receptacle including the container 11' of FIG. 8, the lid is removable from such container 11' only upon each turning of the lid to an angular extent corresponding to a four-hour interval on the scale of hour designations provided on the respective rim 16'. Therefore, the proper time intervals for taking various medications are clearly established by the respective receptacle.

It will be apparent from the foregoing that medication receptacles according to the present invention, while being simple in construction and operation, effectively avoid the accidental taking or administering of pills, tablets or other medication at incorrect time intervals.

Although illustrative embodiments of the invention have been described in detail herein with reference to the accompanying drawing, it is to be understood that the invention is not limited to those precise embodiments, and that various changes and modifications may be effected therein by one skilled in the art without departing from the scope or spirit of the invention as defined in the appended claims.

What is claimed is:

1. A receptacle for medication to be taken at prescribed intervals of time, comprising a container member having an opening at the top thereof with a generally circular rim extending around said opening and defining an annular shoulder facing axially away from said opening, a lid member engageable with said rim for closing said opening and being rotatable in respect to said rim when engaged with the latter, said container member having a scale of hour designations angularly spaced apart thereabout adjacent said lid member, said lid member having index means thereon cooperating with said scale for selectively indicating various times in response to turning of said lid member relative to said rim of the container member, said lid member having an annular flange which nests axially with respect to said rim when the lid member closes said opening, a keeper extending radially from said flange for engaging under said shoulder and thereby retaining said lid member in engagement with said rim, said keeper being angularly aligned with said index means on the lid member, and said rim having a plurality of uniformly angularly spaced recesses therein interrupting said shoulder to permit the passage of said keeper and being angularly aligned with selected ones of said hour designations of the scale which represent said prescribed intervals of time so that said lid member is removable from said container member only when said lid member is turned to any selected one of a plurality of positions where said index means and said selected hour designations indicate respective times.

2. A receptacle for medication according to claim 1; in which said rim has an inner portion defining said annular shoulder at the inside of said container member, said lid member includes a top wall having a peripheral portion adapted to seat on the top of said rim when said lid member closes said opening and having said annular flange depending from said top wall and spaced inwardly from the periphery of the latter so as to fit into said opening and extend below said shoulder when said top wall seats on said top of the rim, said keeper projects radially outward from the lower portion of said flange of the lid member so as to engage under said shoulder when said top wall seats on said top of the rim, said inner portion of the rim has said plurality of angularly spaced recesses opening radially inward and extending from said shoulder to said top of the rim, and each of said recesses is dimensioned to permit the passage therethrough of said keeper for insertion and removal of said lid member in the respective one of said angularly spaced apart positions of the lid member relative to said container member.

3. A receptacle for medication according to claim 2; in which said index means on the lid member is constituted by a tab extending radially outward from said periphery of the top wall and being substantially radially aligned with said keeper so that upward displacement of said tab with said lid member in a selected one of said angularly spaced apart positions is effective to cause the upward travel of said keeper through the respective one of said recesses and the removal of said lid member from said container member.

4. A receptacle for medication according to claim 3; in which said scale of hour designations is provided on an outwardly facing cylindrical surface of said rim.

5. A receptacle for medication according to claim 4; in which said outwardly facing cylindrical surface has protrusions extending therefrom and bracketing said times having the prescribed intervals therebetween.

6. A receptacle for medication according to claim 3; in which at least said lid member is formed of a plastic material, and said flange of the lid member has an annular bead extending around the outer surface of the flange and adapted to snap under said shoulder for yieldably retaining said lid member in closing relation to said container member even when said lid member is in a selected one of said angularly spaced apart positions.

* * * * *